United States Patent [19]

Parker

[11] 4,232,900

[45] Nov. 11, 1980

[54] CHAIR CONTROL

[75] Inventor: James A. Parker, Orange, Mass.

[73] Assignee: Collier-Keyworth Company, Gardner, Mass.

[21] Appl. No.: 24,402

[22] Filed: Mar. 26, 1979

[51] Int. Cl.[2] ..... A47C 7/40

[52] U.S. Cl. ..... 297/305; 248/578

[58] Field of Search ..... 297/304, 305, 306; 248/578

[56] References Cited

U.S. PATENT DOCUMENTS

| | | | |
|---|---|---|---|
| 366,262 | 7/1887 | Schumacher | 248/578 |
| 1,586,166 | 5/1926 | Travers | 248/578 |
| 1,986,105 | 1/1935 | Foote | 297/304 X |
| 2,188,605 | 1/1940 | Herold | 297/304 |
| 2,249,750 | 7/1941 | Dickson | 297/305 |
| 2,410,871 | 11/1946 | Fields et al. | 297/305 |

*Primary Examiner*—Francis K. Zugel

[57] ABSTRACT

A chair control for adjustment of the rest position of a resiliently pivotable chair back, and of the degree of resiliency of the connection of the chair back to the chair frame. A spring brace is mounted on the frame beneath the seat and provides an aperture. A rod assembly connected to the chair back at a universal joint has its remote and extending through the aperture, the rod assembly being slidable through the aperture. A spring tension handwheel concentric with the rod assembly is disposed between the spring brace and the universal joint, and is internally threaded for axially adjustable connection to the rod assembly. A spring retainer is provided on the face of the spring brace nearest the universal joint, and has an aperture corresponding with the spring brace aperture. A compression spring concentric with the rod assembly is confined between the spring retainer and the spring tension handwheel. The chair control further comprises rod assembly front travel stop means adjacent the rod assembly remote end and engageable with the spring brace, and chair back rest position control means connected to the rod assembly for adjusting the distance between the front travel stop means and the universal joint.

5 Claims, 9 Drawing Figures

FIG 2
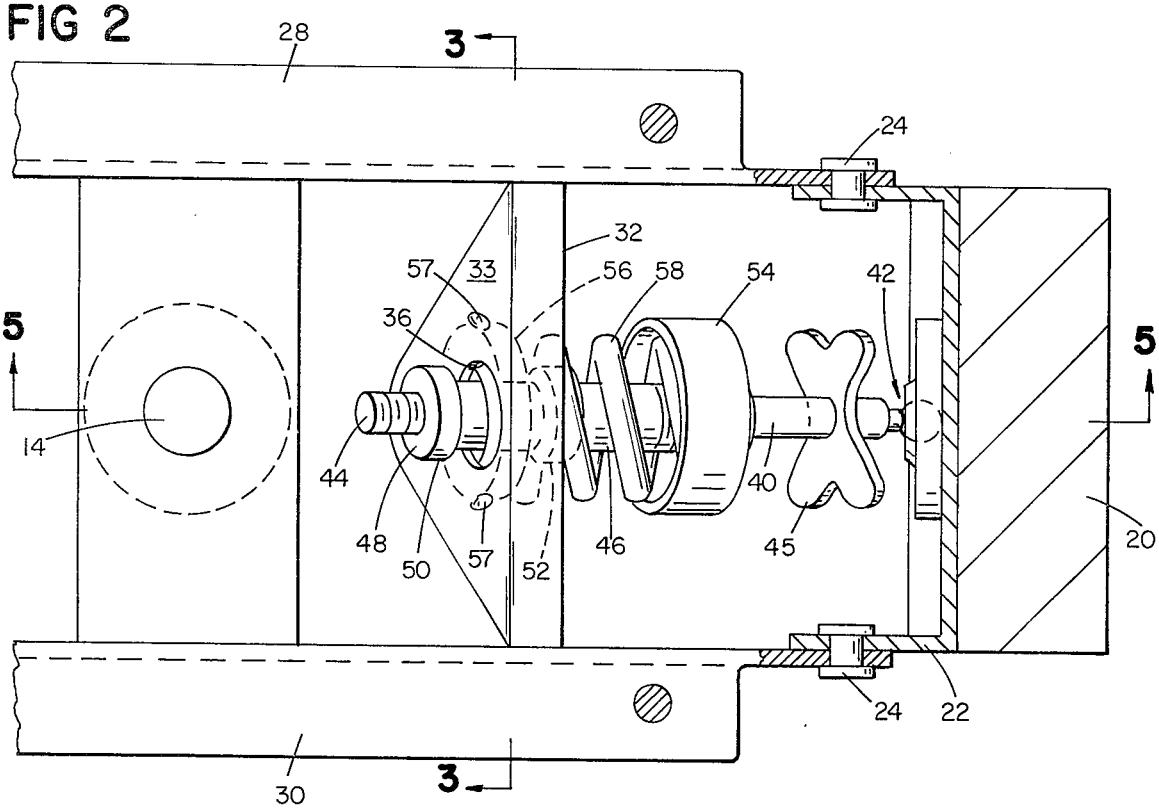
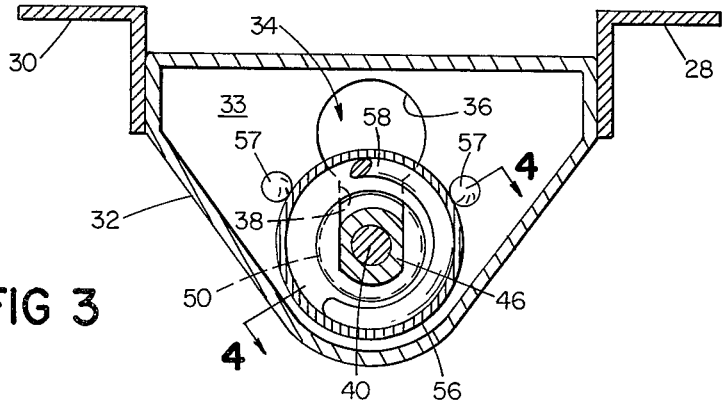
FIG 3
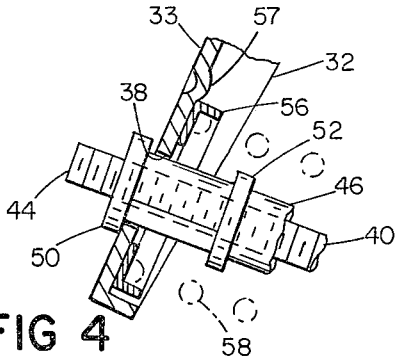
FIG 4
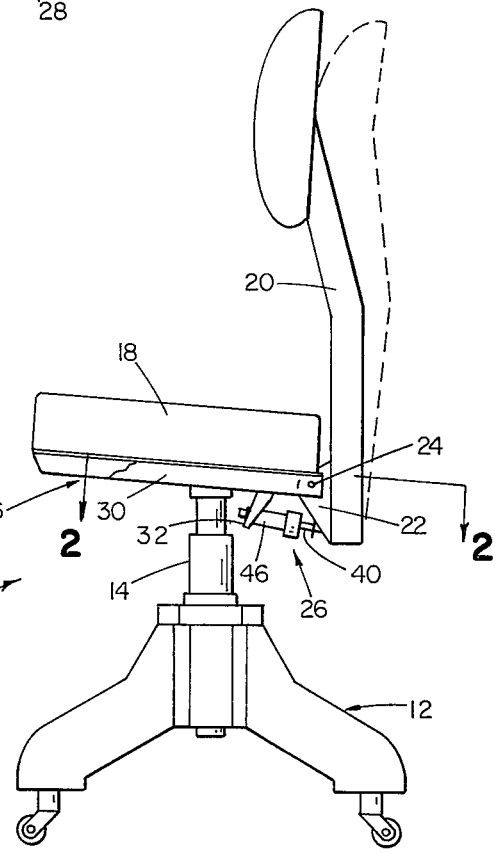
FIG 1

FIG 5
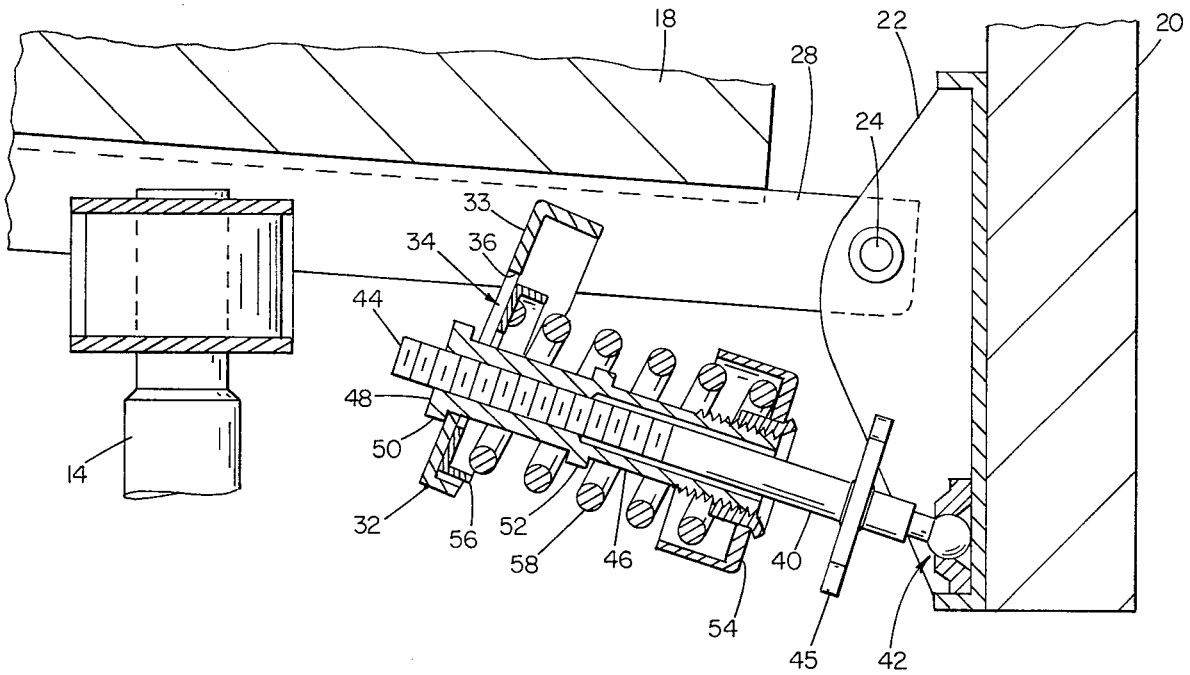
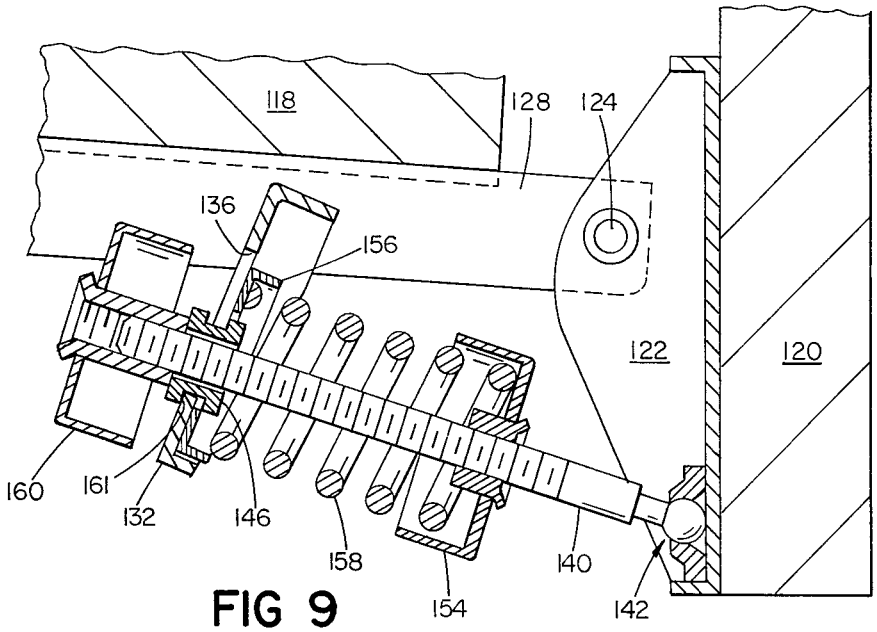
FIG 9

FIG 6
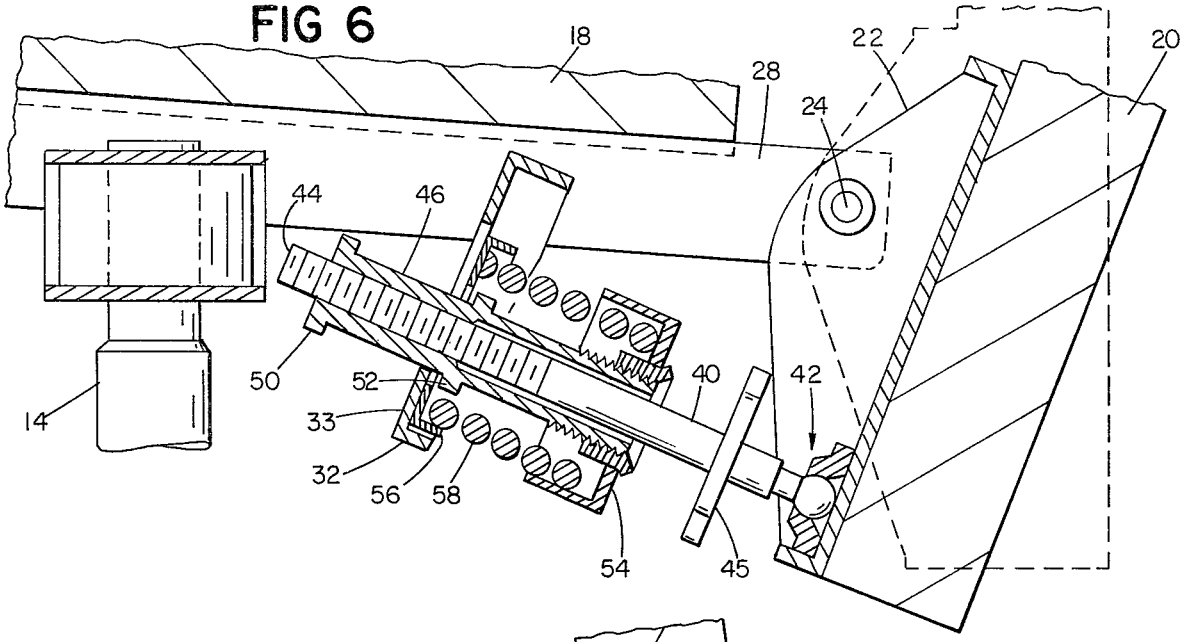
FIG 7
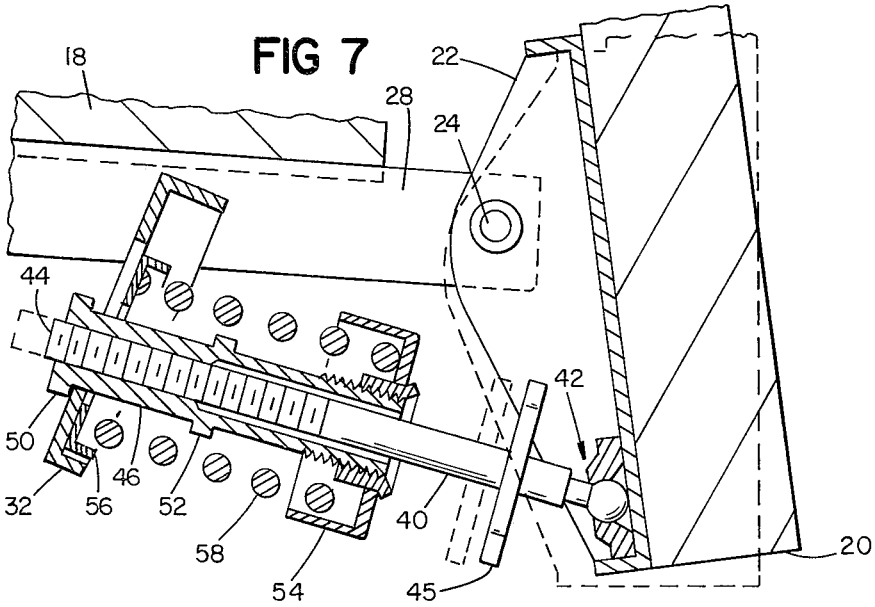
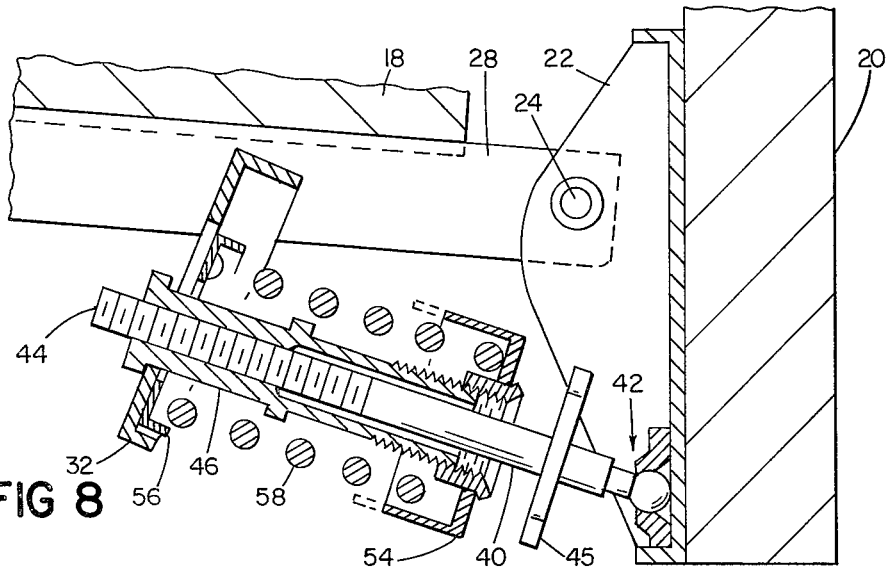
FIG 8

CHAIR CONTROL

This invention relates to a control unit for a chair having a resiliently tiltable chair back, such as stenographic chairs. In particular it relates to a control unit for both the adjustment of the degree of resiliency of the connection of the chair back to the chair frame, and the adjustment of the chair back rest position.

Control units for such chairs are known, but are often difficult for the user of the chair to adjust. Such control units are further frequently composed of a large number of parts, making them expensive to manufacture, and also making them heavy and therefore expensive to ship. In addition, many known chair control units are unsightly and conspicuous.

It is therefore desirable to provide a control unit for a stenographic chair that is composed of relatively few parts, and that is therefore inexpensive to manufacture and to ship. It is also desirable to provide a control unit that is convenient to adjust. It is further desirable to provide a control unit which increases the attractive appearance of the chair, in that the mechanism is relatively inconspicuous.

It is the object of the present invention to provide a chair control having all these advantages.

According to the invention, a chair control is provided in a chair having a base, a vertical post supported by the base, a frame rotatable with respect to the base, a chair seat mounted on the frame, and a chair back resiliently and pivotably connected to the frame for tilt and return of the chair back to a rest position.

The chair control comprises a rod support unit comprising a spring brace mounted on the frame beneath the seat and providing an aperture, and a rod assembly connected to the chair back at a universal joint and having its remote end extending through the aperture, the rod assembly being slidable through the aperture. A spring tension handwheel is concentric with the rod assembly and disposed between the rod support unit and the universal joint, the spring tension handwheel being internally threaded for axially adjustable connection to the rod assembly. The rod support unit further comprises a spring retainer on the face of the spring brace nearest the universal joint, the spring retainer having an aperture corresponding with the spring brace aperture.

A compression spring is concentric with the rod assembly and confined between the spring retainer and the spring tension handwheel. The chair control further comprises rod assembly front travel stop means adjacent the rod assembly remote end and engageable with the rod support unit, and chair back rest position control means connected to the rod assembly for adjusting the distance between the front travel stop means and the universal joint.

In a first embodiment, the rod assembly comprises a control rod and a bushing. The control rod is connected to the chair back at a universal joint, the rod having its remote end extending through the spring brace aperture, the rod being externally threaded adjacent the remote end, and providing a turn screw adjacent the universal joint for rotating the rod. A bushing surrounds the rod between the turn screw and the rod remote end, the bushing having its remote end extending through the spring brace aperture, the bushing being internally threaded adjacent the bushing remote end for axially adjustable connection to the rod. The bushing is externally threaded adjacent the turn screw, and provides front and back travel stop means engageable with the spring brace.

The chair control further comprises means for preventing rotation of the bushing with respect to the rod support means. The means for preventing rotation together with the control rod turn screw together comprise the chair back rest position control means.

In this embodiment, the tilt of the chair back in its rest position and the force required to move the chair back from its rest position are independently adjustable.

In a second embodiment, the rod assembly comprises a control rod connected to the chair back at a universal joint, the control rod being externally threaded over at least a major portion of its length. The spring tension handwheel is threadedly connected to the control rod. The rod support unit further comprises a bushing extending through the spring brace aperture and axially fixed with respect to the aperture; the bushing provides a bushing stop surface adjacent the rod remote end, the control rod being slidable through the bushing.

The chair back rest position control means comprises a second handwheel internally threaded for axially adjustable connection to the control rod remote end, the second handwheel providing a handwheel stop surface adjacent the bushing and engageable with the bushing stop surface, the handwheel stop surface comprising the rod assembly front travel stop means.

In this embodiment, the compression of the spring is altered whenever the rest position of the chair back is changed. The second handwheel must be separately rotated in order to readjust the compression of the spring as desired.

Other objects, features and advantages will be apparent from the following description of a preferred embodiment of the invention, together with the drawing, in which:

FIG. 1 shows a stenographer's chair including the chair control of the invention;

FIG. 2 is a view of the chair control as seen from above, taken on the lines 2—2 of FIG. 1;

FIG. 3 is a section taken on the line 3—3 of FIG. 2;

FIG. 4 is a detail view taken on the line 4—4 of FIG. 3;

FIG. 5 is a section taken on the line 5—5 of FIG. 2;

FIGS. 6, 7 and 8 are similar to FIG. 5 but show certain portions of the chair control displaced with respect to other portions; and FIG. 9 shows an alternative embodiment of the chair control.

Referring now to the drawings, and in particular to FIG. 1, a stenographic chair 10 comprises a base 12, a vertical post 14 supported by base 12, and a frame 16 rotatable with respect to base 12. A chair seat 18 is mounted on frame 16, and a chair back 20 is connected to frame 16 through a bracket 22, pivotable at rivets 24 (only one of which is visible in FIG. 1) about a pivot axis.

A chair control assembly 26 according to the invention is mounted between chair back 20 and frame 16.

Referring now to FIG. 2, a portion of frame 16 is seen, comprising side brackets 28 and 30. A rod support unit comprising a spring brace 32 is mounted between brackets 28 and 30 and extends downwardly and forwardly (away from chair back 20). Spring brace 32 is generally concave toward chair back 20, and provides a front wall 33, in which is a keyhole shaped aperture 34, comprising a generally circular upper portion (assembly portion) 36 and a narrower, straight-sided lower portion (operative portion) 38. Aperture 34 is at a level below that of the chair back pivot axis. The face of front wall 33 toward the chair back is defined as the internal face.

A rod assembly comprising a control rod 40 and a plastic bushing 46 concentric therewith is slidable through aperture 34. Control rod 40 is connected to chair back 20 at a universal joint 42, at a level below that of aperture 34. The remote end 44 of rod 40 extends through aperture 34, rod 40 being externally threaded adjacent remote end 44. Rod 40 provides a turn screw 45 adjacent universal joint 42 for rotating rod 40.

Plastic bushing 46 surrounds rod 40 between turn screw 45 and rod remote end 44. The remote end 48 of bushing 46 extends through aperture 34. As seen in the sectional views of FIGS. 5 through 8, bushing 46 is internally threaded adjacent its remote end 48, for axially adjustable connection to the externally threaded portion of rod 40. The remainder of the internal surface of bushing 46 is unthreaded and of slightly greater diameter than rod 40, the unthreaded internal surface of bushing 46 being spaced from the external surface of rod 40. Bushing 46 is externally threaded adjacent turn screw 45.

Bushing 46 provides annular ridges 50 and 52 of external diameter greater than the width of aperture operative portion 38. Ridges 50 and 52 are on either side of spring brace front wall 33, and engage with wall 33 to function as rod assembly front and back travel stop means respectively.

The portion of bushing 46 between ridges 50 and 52 is flattened at its sides, as best seen in FIG. 3, in order to engage with the straight-sided portions of aperture operative portion 38 to prevent rotation of bushing 46 relative to spring brace 32.

A spring tension handwheel 54 surrounds bushing 46 between spring brace 32 and rod turn screw 45; tension handwheel 54 is concave away from turn screw 45, and is internally threaded for axially adjustable connection to bushing 46.

The rod support unit further comprises a spring retainer 56 on the internal face of spring brace front wall 33, concave toward tension handwheel 54 and of similar diameter. Spring retainer 56 provides an aperture corresponding with the lower portion 38 of spring brace aperture 34. A compression spring 58 surrounds bushing 46 and is confined between spring retainer 56 and tension handwheel 54. Two detents or dimples 57 in front wall 33 retain spring retainer 56 (as best seen in FIG. 4) and thereby prevent the rod and bushing assembly from being displaced upwardly within aperture 34.

Referring to FIG. 6, when the occupant of chair 10 leans against chair back 20, bracket 22 pivots about pivot rivet 24, carrying universal joint 42 forward beneath chair seat 18. Rod 40 is thereby moved forwardly with respect to spring brace member 32, carrying bushing 46 and tension handwheel 54 with it. Travel of rod 40 and bushing 46 is limited by the engagement of back travel stop means 52 with front wall 33 of spring brace 32. This limits the backward travel of chair back 20. The travel of chair back 20 is opposed by the force of compression spring 58, which is compressed between spring brace 32, which does not move, and tension handwheel 54, which does.

Referring to FIG. 7, the rest position of chair back 20 is adjusted by rotation of turn screw 45. When turn screw 45 is rotated in a sense to move rod 40 away from spring brace 32, bushing 46 is prevented from rotating by the engagement of its flat portions with the straight-sided portion 38 of aperture 34. Therefore, rotation of rod 40 retracts the rod within bushing 46, and increases the distance between front travel stop means 50 and universal joint 42. Since spring 58 acts against tension handwheel 54 to pull bushing 46 toward universal joint 42, front travel stop means 50 continues to engage spring brace 32, while universal joint 42 is in effect moved back. Bracket 22 is thereby pivoted about rivet 24. As is seen in the Figure, this adjustment tilts chair back 20 forwardly with respect to chair seat 18. Since tension handwheel 54 remains stationary with respect to spring brace 32, the length of spring 58 is unaffected by this adjustment.

Referring now to FIG. 8, the uncompressed length of spring 58 is varied by rotation of tension handwheel 54 with respect to bushing 46. As is seen in the Figure, if handwheel 54 is retracted toward turn screw 45, spring 58 is permitted to expand, thereby reducing the force required to move chair back 20 from its rest position. However, the rest position is not changed by this adjustment.

Therefore, in this embodiment of the invention, the tilt of the chair back 20 in its rest position and the force required to move chair back 20 from its rest position are independently adjustable.

An alternative embodiment of the invention is shown in FIG. 9. In this embodiment, chair back 120 is mounted on bracket 122, which pivots at 124 with respect to frame member 128. A rod support unit comprises a spring brace 132 mounted on frame member 128, similar in structure to spring brace 32 of the first embodiment. Brace 132 provides an aperture having a circular upper portion 136 and a lower portion (not visible in the drawing). The rod support unit further comprises a spring retainer 156, having an aperture corresponding with the lower portion of the spring brace aperture, and a short nylon bushing 146 within the aperture of spring brace 132. Bushing 146 is not internally threaded.

A rod 140 is mounted on bracket 122 at a universal joint 142, and extends slidably through bushing 146. Rod 140 is externally threaded over the major part of its length, being unthreaded adjacent joint 142. A tension handwheel 154 is internally threaded and is directly connected to the threaded surface of rod 140. A compression spring 158 concentric with rod 140 is confined between spring retainer 156 and tension handwheel 154.

In this embodiment, the chair back rest position control means comprises a second handwheel 160, which is internally threaded for axially adjustable connection to rod 140. The annular surface 161 of second handwheel 160 engages the outer surface of bushing 146 and functions as a rod assembly front travel stop. (The back travel stop function is provided by complete compression of spring 158 against spring brace 132.) If second handwheel 160 is rotated in a first sense to retract it with respect to rod 140, expansion of spring 158 against tension handwheel 154 pulls second handwheel 160 up to bushing 146. Therefore, rod 140 moves universal joint 142 away from the front travel stop surface 161 and from spring brace 132, thereby pivoting the lower end of bracket 122 back about pivot point 124. If second handwheel 160 is rotated in the opposite sense to advance it with respect to rod 140, the lower end of bracket 122 is pivoted forwardly about pivot point 124. Therefore rotation of second handwheel 160 adjusts the rest position of chair back 120.

However, in this embodiment, tension handwheel 154 is carried with rod 140, thereby varying the compression of spring 158 whenever the rest position of chair back 120 is varied. Tension handwheel 154 must be separately rotated in order to adjust the compression of spring 158 as desired.

In both embodiments of the invention, the back travel of the chair back (compressing the spring) is limited by structure that is independent of chair post 14. In the first embodiment, back travel stop means 52 is provided on bushing 46; in the second embodiment, the back travel is limited by full compression of spring 158 against spring brace 132. Therefore, by attaching the chair control to longer brace elements, the upright position of the chair back can be moved backward with respect to the post and the chair seat, without affecting the operation of the chair control. This makes the chair control of the invention particularly versatile.

Further, because the means to adjust both the tilt and the spring compression are located on the control rod, which is centrally located with respect to rivets 24, the rivets are equally loaded in use and therefore tend to wear evenly. This contributes to the durability of the mechanism.

What is claimed is:

1. In a chair having a base, a vertical post supported by said base, a frame rotatable with respect to said base, a chair seat mounted on said frame, and a chair back resiliently and pivotably connected to said frame for tilt and return of said chair back to a rest position, a chair control for adjustment of said chair back rest position and adjustment of the degree of resiliency of said connection, said control comprising a rod support unit comprising a spring brace mounted on said frame beneath said seat and providing an aperture, a rod assembly connected to said chair back at a universal joint and having its remote end extending through said aperture, said rod assembly being slidable through said aperture, a spring tension handwheel concentric with said rod assembly and disposed between said rod support unit and said universal joint, said spring tension handwheel being internally threaded for axially adjustable connection to said rod assembly, said rod support unit further comprising a spring retainer on the face of said spring brace nearest said universal joint, said spring retainer having an aperture corresponding with said spring brace aperture, a compression spring concentric with said rod assembly and confined between said spring retainer and said spring tension handwheel, said chair control further comprising rod assembly front travel stop means adjacent said rod assembly remote end and engageable with said rod support unit, and chair back rest position control means connected to said rod assembly for adjusting the distance between said front travel stop means and said universal joint.

2. The chair control of claim 1, wherein said rod assembly comprises a control rod connected to said chair back at a universal joint, said rod having its remote end extending through said spring brace aperture, said rod being externally threaded adjacent said remote end, and providing a turn screw adjacent said universal joint for rotating said rod, and a bushing surrounding said rod between said turn screw and said rod remote end, said bushing having its remote end extending through said spring brace aperture, said bushing being internally threaded adjacent said bushing remote end for axially adjustable connection to said rod, said bushing being externally threaded adjacent said turn screw, said bushing providing front and back travel stop means engageable with said spring brace, said chair control further comprising means for preventing rotation of said bushing with respect to said rod support unit, said means for preventing rotation together with said control rod turn screw together comprising said chair back rest position control means.

3. The chair control of claim 1, wherein said rod assembly comprises a control rod connected to said chair back at a universal joint, said control rod being externally threaded over at least a major portion of its length, said spring tension handwheel being threadedly connected to said control rod, said rod support unit further comprising a bushing extending through said spring brace aperture and axially fixed with respect to said aperture, said bushing providing a bushing stop surface adjacent said rod remote end, said control rod being slidable through said bushing, said chair back rest position control means comprising a second handwheel internally threaded for axially adjustable connection to said control rod remote end, said second handwheel providing a handwheel stop surface adjacent said bushing and engageable with said bushing stop surface, said handwheel stop surface comprising said rod assembly front travel stop means.

4. In a chair having a base, a vertical post supported by said base, a frame rotatable with respect to said base, a chair seat mounted on said frame, and a chair back resiliently and pivotably connected to said frame for tilt about a pivot axis and return of said chair back to a rest position, a chair control for adjustment of said chair back rest position and independent adjustment of the degree of resiliency of said connection, said control comprising a spring brace mounted on said frame beneath said seat and providing a front wall defining an aperture, said aperture including an assembly portion and an operative portion of smaller diameter than said assembly portion, said aperture operative portion perimeter including non-circular portions, said aperture being at a level below that of said pivot axis, said spring brace front wall having an internal face adjacent said chair back, a control rod connected to said chair back at a universal joint at a level below that of said spring brace aperture, said rod having its remote end extending through said spring brace aperture operative portion, said rod being externally threaded adjacent said remote end, and providing a turn screw adjacent said universal joint for rotating said rod, a bushing surrounding said rod between said turn screw and said rod remote end, said bushing having its remote end extending slidably through said spring brace aperture operative portion, said bushing being internally threaded adjacent said bushing remote end for axially adjustable connection to said rod, said bushing being externally threaded adjacent said turn screw, said bushing providing first and second annular ridges of external diameter greater than the internal diameter of said spring brace aperture operative portion, said first ridge being between said bushing remote end and said spring brace aperture, said second ridge being between said spring brace aperture and said turn screw, said ridges being engageable with said spring brace front wall, a spring tension handwheel concentric with said rod and disposed between said spring brace and said universal joint, said spring tension handwheel being internally threaded for axially adjustable connection to said bushing, a spring retainer adjacent said spring brace front wall internal face, said spring retainer having an aperture corresponding with said spring brace aperture operative portion, said spring brace front wall including detent means for maintaining said spring retainer with its said aperture in correspondence with said spring brace aperture operative portion, and a compression spring concentric with said rod and confined between said spring retainer and said spring tension handwheel, said bushing having non-cylindrical surface portions between said ridges, said surface portions engaging said spring brace aperture perimeter non-circular portions for preventing rotation of said bushing with respect to said spring brace.

5. In a chair having a base, a vertical post supported by said base, a frame rotatable with respect to said base, a chair seat mounted on said frame, and a chair back resiliently and pivotably connected to said frame for tilt about a pivot axis and return of said chair back to a rest position, a chair control for adjustment of said chair back rest position and adjustment of the degree of resiliency of said connection, said control comprising a spring brace mounted on said frame beneath said seat and providing a front wall defining an aperture, said aperture including an assembly portion and an operative portion of smaller diameter than said assembly portion, said aperture operative portion perimeter including non-circular portions, said aperture being at a level below that of said pivot axis, said spring brace front wall having an internal face adjacent said chair back, a control rod connected to said chair back at a universal joint at a level below that of said spring brace aperture, said rod having its remote end extending through said spring brace aperture operative portion, said rod being externally threaded over at least a major portion of its length, a bushing extending through said spring brace aperture operative portion, said bushing providing first and second annular ridges of external diameter greater than the internal diameter of said spring brace aperture operative portion, said ridges being disposed on either side of said spring brace front wall and engaging said wall for fixing said bushing axially with respect to said spring brace, said control rod being slidable through said bushing, a spring tension handwheel concentric with said rod and disposed between said spring brace and said universal joint, said spring tension handwheel being internally threaded for axially adjustable connection to said rod, a spring retainer adjacent said spring brace front wall internal face, said spring retainer having an aperture corresponding with said brace aperture operative portion, said spring brace front wall including detent means for maintaining said spring retainer with its said aperture in correspondence with said spring brace aperture operative portion, a compression spring concentric with said rod and confined between said spring retainer and said spring tension handwheel, and a second handwheel internally threaded for axially adjustable connection to said control rod remote end, said second handwheel providing a handwheel stop surface adjacent said bushing and engageable therewith.

* * * * *